US005173384A

United States Patent [19]

Otsuka

[11] Patent Number: 5,173,384

[45] Date of Patent: Dec. 22, 1992

[54] ELECTROPHOTOGRAPHIC PHOTORECEPTOR

[75] Inventor: Shigenori Otsuka, Omiya, Japan

[73] Assignee: Mitsubishi Kasei Corporation, Tokyo, Japan

[21] Appl. No.: 865,706

[22] Filed: Apr. 8, 1992

Related U.S. Application Data

[63] Continuation of Ser. No. 593,517, Oct. 2, 1990, abandoned, which is a continuation of Ser. No. 339,710, Apr. 18, 1989, abandoned.

[30] Foreign Application Priority Data

Apr. 19, 1988 [JP] Japan ..... 63-96144

[51] Int. Cl.[5] ..... G03G 5/047

[52] U.S. Cl. ..... 430/59; 430/58

[58] Field of Search ..... 430/58, 59

[56] References Cited

U.S. PATENT DOCUMENTS

| | | | |
|---|---|---|---|
| 3,754,906 | 8/1973 | Jones | 430/91 X |
| 4,055,420 | 10/1977 | Limburg | 430/67 |
| 4,352,876 | 10/1982 | Suzuki et al. | 430/58 |
| 4,396,696 | 8/1983 | Nagasaka et al. . | |
| 4,471,039 | 9/1984 | Borsenberger | 430/64 X |
| 4,490,452 | 12/1984 | Champ et al. | 430/59 X |
| 4,514,482 | 4/1985 | Loutfy | 430/58 X |
| 4,618,555 | 10/1986 | Suzuki et al. . | |
| 4,619,877 | 10/1986 | Borsenberger | 430/57 X |
| 4,701,395 | 10/1986 | Wronski | 430/58 |
| 4,791,194 | 12/1986 | Suzuki et al. . | |

FOREIGN PATENT DOCUMENTS

| | | | |
|---|---|---|---|
| 0120581 | 10/1984 | European Pat. Off. . | |
| 0289216 | 2/1988 | European Pat. Off. . | |
| 63-058451 | 2/1988 | Japan . | |
| 1337222 | 11/1973 | United Kingdom . | |
| 2032637 | 5/1980 | United Kingdom | 430/59 |

OTHER PUBLICATIONS

Patent Abstracts of Japan, vol. 9, No. 40, (P-336) (1763), 1985.

*Primary Examiner*—Roland Martin

*Attorney, Agent, or Firm*—David G. Conlin; Peter F. Corless; Ernest V. Linek

[57] ABSTRACT

According to the present invention, there is provided a layered-type organic electrophotographic photoreceptor in which a charge generating layer containing organic charge generating material and a charge transporting layer containing organic charge transporting material are constructed on an electroconductive support, characterized in that a value n is not greater than 0.5 in the following equation (1):

$$\eta = \eta_o E^n \quad (1)$$

where $\eta$ represents a quantum yield as the whole photoreceptor, E represents an electric field and $\eta_o$ represents a constant, and that a film thickness of said charge transporting layer is not less than 30 $\mu$m.

3 Claims, 5 Drawing Sheets

ELECTROPHOTOGRAPHIC PHOTORECEPTOR

This is a continuation of copending application(s) Ser. No. 07/593,517 filed on Oct. 2, 1990, now abandoned which is a continuation of Ser. No. 07/339,7 filed Apr. 18, 1989, now abandoned.

BACKGROUND OF THE INVENTION

1. Field of the Invention

The present invention relates to an electrophotographic photoreceptor. More particularly, it relates to a highly sensitive and durable electrophotographic photoreceptor.

2. Prior Art

In these days, an electrophotographic technique, which may instantly produce an image with a high quality, has been widely used and applied in the fields of various kinds of printers as well as of a copying machine.

As photoconductive materials for the photoreceptor which is one of the essential part of the electrophotographic technique, inorganic ones such as selenium, arsenic-selenium alloy, cadmium sulfide and zinc oxide have been generally used. In addition, organic photoconductive materials have been recently used for the photoreceptor because they have many advantages over the inorganic photoconductive materials, for example, they are light in weight and may be easily prepared and formed into a film.

As the organic photoreceptor, there have been known of a so-called dispersed type in which fine photoconductive powder is dispersed in a binder resin and of a layered type comprising a charge generating layer and a charge transporting layer on an electroconductive support. Please refer to, for example, U.S. Pat No. 4,396,696. The latter type is mainly put to a practical use in view of its high sensitivity and high durability against printing.

However, the sensitivity and durability of the conventional organic layered-type photoreceptor are still insufficient as compared with inorganic one which uses arsenic-selenium alloy. Therefore, various attempts have been made for further improving such properties.

New photosensitive material with higher sensitivity has been sought for improving the sensitivity of the photoreceptor, while photosensitive material which will deteriorate little and binder material with high mechanical strength have been also sought for improving its durability. As a result, materials having a sufficient sensitivity and electric durability have been successfully developed. However, the photosensitive material with a sufficient mechanical durability has been not yet obtained.

Consequently, a photosensitive layer may be abrased and its film thickness may accordingly be decreased by a practical load such as friction with toner or paper, or friction with a cleaning member although a degree of the decrease depends on the method and load used. Such decrease in the film thickness may result in reduction of a charging property and, when the reduction exceeds an allowable range in a developing system, the life of the photoreceptor will expire so as to deteriorate the durability against printing.

The mechanical durability may vary mainly depending on the binder resin for the charge transporting layer. Although acrylic resin, methacrylic resin, polyester resin, polycarbonate resin and the like are usually used for the binder resin, these materials have not yet been provided with a sufficient strength in the prior art. Accordingly, when they are used in a process having a normal blade-cleaning system, the photosensitive layer will be remarkably abrased by copying for several tens of thousands of sheets, causing the need of replacement thereof. Although varying depending on the resin material and process, the decrease of the film in thickness caused by such abrasion is usually about from 0.2 to 1 μm after copying ten thousands of sheets. Various studies have been therefore made on the conditions of use and on new materials in order to decrease an amount of said abrasion.

The present inventors have made various studies to find a method of improving the durability while using various conventional materials, and have found that the change of electrical properties due to the abrasion, particularly, the reduction in a charging capacity can be prevented by sufficiently increasing the film thickness of the photosensitive layer as compared with the conventional ones, specifically, by greatly increasing the film thickness of the charge transporting layer.

However, for an usual layered-type photoreceptor, the electrical properties were proved to be remarkably degraded by increasing the film thickness of the charge transporting layer, causing a decrease in the sensitivity and a remarkable increase in a residual potential, which can be no more suitable to practical use.

It has been now found, however, that the above disadvantages may be compensated, or rather the sensitivity may be improved as long as the layered-type photoreceptor has specific electric properties, even if the thickness of the charge transporting layer is made much thicker than the conventional layer of about 10 to 20 μm thickness. Consequently, photosensitive material with more excellent durability and higher sensitivity as compared to the conventional one may be obtained.

SUMMARY OF THE INVENTION

Thus, an object of the present invention is to provide a photoreceptor of excellent durability and sensitivity by combining a charge generating layer and a charge transporting layer such that the photoreceptor should have a sufficiently low electric-field dependency of a quantum yield $\eta$ and by defining a specific film thickness for the charge transporting layer.

Namely, the present invention resides in a layered-type organic electrophotographic photoreceptor in which a charge generating layer containing organic charge generating material and a charge transporting layer containing organic charge transporting material are constructed on an electroconductive support, characterized in that a value n is not greater than 0.5 in the following equation (1):

$$\eta=\eta_0 E^n \quad (1)$$

where $\eta$ represents a quantum yield as the whole photoreceptor, E represents an electric field and $\eta_0$ represents a constant, and that a film thickness of said charge transporting layer is not less than 30 μm.

DETAILED DESCRIPTION OF THE PREFERRED EMBODIMENTS

Figure 1:
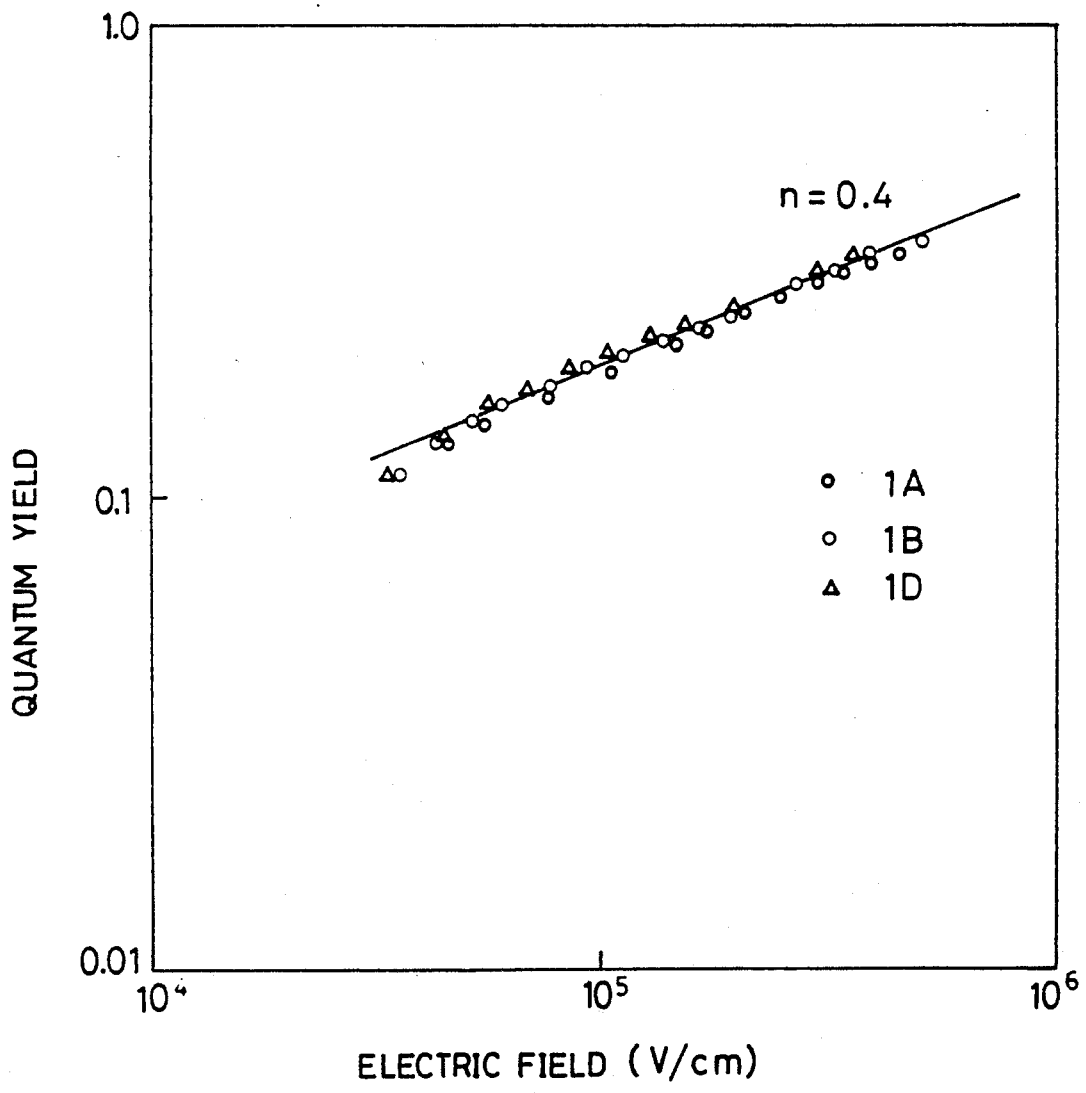
FIG. 1 illustrates the quantum yield of the photoreceptor in Example 1 and the electric-field dependency thereof.

The present invention is to be described more in detail.

The photoreceptor according to the present invention basically comprises the charge generating layer and the charge transporting layer. It is preferred that the charge generating layer and the charge transporting layer may be constructed in this order on the electroconductive support. Accordingly, the following description will be made with reference to this type, the invention being, however, not limited thereto.

As the electroconductive support, there may be used metal materials such as aluminum, stainless steel, copper and nickel, insulative supports such as polyester film and paper having on its surface an electroconductive layer made of aluminum, copper, palladium, tin oxide, indium oxide or the like.

A known barrier layer employed usually may be disposed between the electroconductive support and the charge generating layer. As the barrier layer, there may be used, for example, a metal oxide layer such as anodized aluminum film, and a resin layer such as of polyamide, polyurethane, cellulose or casein. In addition, other layers may also be provided in the photoreceptor according to the present invention.

The photoreceptor according to the present invention necessarily has a specific physical property regarding photoconductivity.

That is, it is necessary that the quantum yield $\eta$ as the whole photoreceptor should have such a low electric-field dependency that the value n is not greater than 0.5, when $\eta$ is approximated by the power of the electric field E as shown by the following equation (1):

$$\eta = \eta_0 E^n \quad (1)$$

The "quantum yield as the whole photoreceptor" used herein is represented as a ratio of the number of electric charges at the surface of the photoreceptor neutralized by the carriers generated under excitation by an incident light for exposing the photoreceptor and transported against the number of photon of said light. The quantum yield is also referred to as a xerographic gain or photoinjection efficiency.

Generally, $\eta$ depends on the electric field and wavelength of the incident light. The "electric field E" used herein is an average electric field applied in the photoreceptor, which means a value obtained by dividing the surface potential with the film thickness of the photoreceptor.

The wavelength of the incident light corresponds to that of the light used for image exposure since the low electric-field dependency described above is required in this wavelength region.

$\eta$ may be measured by a method, for example, as described in the Journal of Physical Review vol. 1, No.12, p 5163–5174, and determined by the following equation:

$$\eta = \frac{C}{eN} \frac{dv}{dt} \Big|_{init}$$

where C is a static capacity of the photoreceptor, e is an electron charge, N is a number of incident photons per unit time and $$\frac{dv}{dt} \Big|_{init}$$

is an initial photo-decaying rate. As the incident light upon measurement, a monochromatic light at the wavelength region used for the image exposure is employed.

Although it is difficult to uniformly determine a mode of the electric-field dependency of the quantum yield, the mode is expressed in the present invention as a slope of an approximated straight line obtained by plotting both the electric field and the quantum yield in a logarithmic scale. Such slope corresponds to the number of power when the quantum yield is expressed by the power of the electric field. For this approximation, linear regression by a general least square method may be effectively used. Generally, the electric-field dependency tends to deviate greatly from the approximated straight line in a lower electric field due to various factors. Then, the electric-field dependency:n used in the present invention may be defined by the straight line approximated preferably in a range from $1\times10^5$ v/cm to $5\times10^5$v/cm of the electric field, which is a region usually employed for the photoreceptor and, more preferably, in a range from $5\times10^4$ v/cm to $5\times10^5$ v/cm.

The quantum yield of the layered-type photoreceptor is determined based both on the charge generating efficiency in the charge generating layer and on injection efficiency from the charge generating layer to the charge transporting layer. However, the loss of charge during injection may be negligible except for in an extremely low electric field region, if the organic charge transporting material is properly selected. Accordingly, in such case, the quantum yield may be substantially determined only by the charge generating efficiency in the charge generating layer. Further, the loss of the charge during transportation will be also negligible if the charge transporting layer is properly selected, so that the quantum yield does not depend on the film thickness. Consequently, for reducing the electric-field dependency of the quantum yield in the present invention, it is necessary to select such charge generating material as having charge generating efficiency with a low electric-field dependency.

It is generally said that the quantum yield of organic photoconductive materials is greatly dependent on the electric field. However, it has been found by the present inventors that the low electric-field dependency of the quantum yield can be attained by appropriately selecting both of the organic charge generating material and the organic charge transporting material. Although such combination of the both materials has not yet been completely specified, the organic charge generating material used in the present invention may be selected from various kinds of organic charge generating materials such as, for example, azo dyes, phthalocyanine dyes, quinacridone dyes, perylene dyes, polycyclic quinone dyes, indigo dyes, benzoimidazole dyes, pyrylium salts, thiapyrylium salts, and squarylium salt pigments, depending on the purpose.

The charge generating layer may be formed as a uniform layer by a vacuum-evaporation of the above charge generating material or as a layer of binder resin in which the same material is dispersed in a finely particulated form. As the binder resin in the latter case, there may be used various types of binder resins such as polyvinyl acetate, polyacrylic ester, polymethacrylic ester, polyester, polycarbonate, polyvinyl butyral, phenoxy resin, cellulose or urethane resin. The charge generating layer may have thickness of usually from 0.1 μm to 1 μm and, preferably from 0.15 μm to 0.6 μm.

Further, as the organic charge transporting material used in the charge transporting layer, there may be mentioned electron attracting materials, for example, 2,4,7-trinitrofluorenone and tetracyano quinodimethane, and electron donating material, for example, heterocyclic compounds such as carbazole, indole, imidazole, oxazole, thiazole, oxadiazole, pyrazole, pyrazoline and thiadiazole; aniline derivatives; hydrazone derivatives; conjugated system compounds having stilbene skelton; and those polymers having groups derived from such compounds in a main or side chain.

tubes and the like as a light source in a general applied electrophotography technique.

The present invention will be more specifically described referring to non-limiting examples, which should, however, not be construed as limiting the scope of the present invention; In the following descriptions, "part(s)" means "part(s) by weight".

EXAMPLE 1

To 10 parts of a bisazo compound I having the following structure, 100 parts of ethyleneglycol dimethyl ether was added and dispersed in a sand grinding mill. The resultant dispersion was mixed with a solution containing 5 parts of phenoxy resin (trade name; PKHH, manufactured by Union Carbide Co.) and 5 parts of polyvinyl butyral resin (#6000, manufactured by DENKI KAGAKU KOGYO KABUSHIKI KAISHA) dissolved in 100 parts of ethyleneglycol dimethyl ether, to obtain a coating solution of a charge generating layer. The coating solution was applied by dipping an aluminum cylinder of 80 mm diameter therein, the surface of which cylinder was mirror-finished, to give the charge generating layer. The film thickness after drying was 0.4 μm.

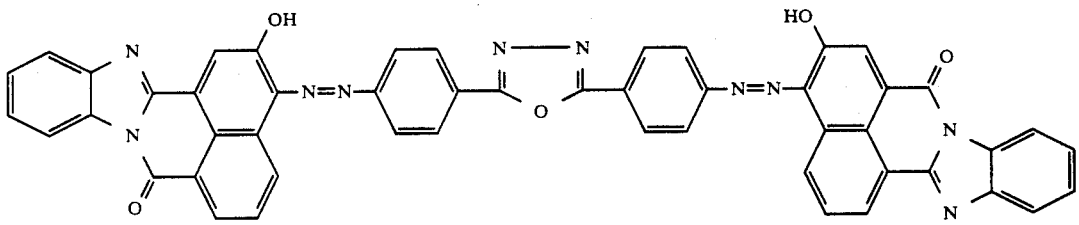

Bisazo compound I

The binder resin may further be blended together with the charge transporting material in the charge transporting layer and, as the binder resin, there may be used thermoplastic resins such as polycarbonate resin, acrylic resin, methacrylic resin, polyester resin, polystyrene resin and silicone resin, as well as various thermosetting resins. Particularly, polycarbonate resin and polyester resin, which cause little damages, even if suffering from abrasion, are preferred. As a bisphenol group for the polycarbonate resin, various known groups such as bisphenol A, C and Z may be used, and those polycarbonates comprising the bisphenol C or Z are preferred.

Further, well-known additives such as ones for improving a film-forming property and flexibility, and ones for suppressing the accumulation of the residual potential may be incorporated in the charge transporting layer according to the present invention. It is necessary that the film thickness of the charge transporting layer should not less than 30 μm, the thickness from 30 μm to 60 μm being preferable, and the thickness from 35 μm to 50 μm being more preferable.

The electrophotographic photoreceptor thus obtained has extremely excellent properties such as the high sensitivity and the remarkably improved durability.

The photoreceptor according to the present invention may be used for electrophotographic copying machines, as well as for printers and facsimiles using light emitting diodes (LED), LCD shutters, cathode-ray On the surface of the charge generating layer thus obtained, a solution comprising 100 parts of N-methyl carbazole-3-aldehyde diphenyl hydrazone, 100 parts of bisphenol A polycarbonate resin (NOVALEX ® 7025 A, manufactured by MITSUBISHI CHEMICAL INDUSTRIES LTD.), 0.5 parts of a cyano compound of the following structure and 8 parts of ditertiary butyl hydroxy toluene (BHT) dissolved in 1,4-dioxane was applied by dipping the previously coated aluminum cylinder therein so that the film thickness of each charge transporting layer upon drying was 10 μm, 17 μm, 25 μm, 30 μm and 40 μm, respectively.

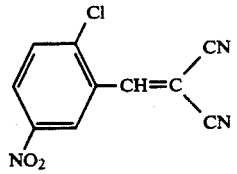

These photoreceptors are referred to as 1-A, 1-B, 1-C, 1-D and 1-E, respectively. For the photoreceptor 1-B, an initial potential-decaying rate was measured by using a monochromatic light at 550 nm as an incident light, and a capacitance of a photosensitive layer was determined to thereby obtain the quantum yield as the whole photoreceptor and the electric-field dependency thereof. The results are shown in FIG. 1. Furthermore, measurements were conducted in the same manner for the samples 1-A and 1-D to obtain substantially the same results, which are also shown in FIG. 1. It can be seen from the results that the quantum yield of the photoreceptor does not depend on the film thickness and that the dependency of the quantum yield of the photoreceptor on the electric field is so low that it may be approximated by an exponent of 0.4 for the electric field. Then, the sensitivities of the samples 1-A, 1-B, 1-C, 1-D and 1-E to white light and to the light at a wavelength of 550 nm were determined as a half-decay exposure amount (an exposure amount required for decaying an initial surface potential 700 V to its half value ) E ½. These results, as well as electrophotographic characteristics such as the charging property and the residual potential are shown in Table 1.

TABLE 1

| Sample | Thickness of charge transporting layer (μm) | Charge voltage (V) | White light E ½ (lux · sec) | 550 nm E ½ (erg/cm²) | Residual potential (V) |
|---|---|---|---|---|---|
| 1-A | 10 | 843 | 1.33 | 4.5 | 2 |
| 1-B | 17 | 1200 | 1.00 | 3.6 | 8 |
| 1-C | 25 | 1360 | 0.85 | 2.6 | 9 |
| 1-D | 30 | 1660 | 0.75 | 2.3 | 11 |
| 1-E | 40 | 1800 | 0.68 | 2.0 | 20 |

Figure 2:
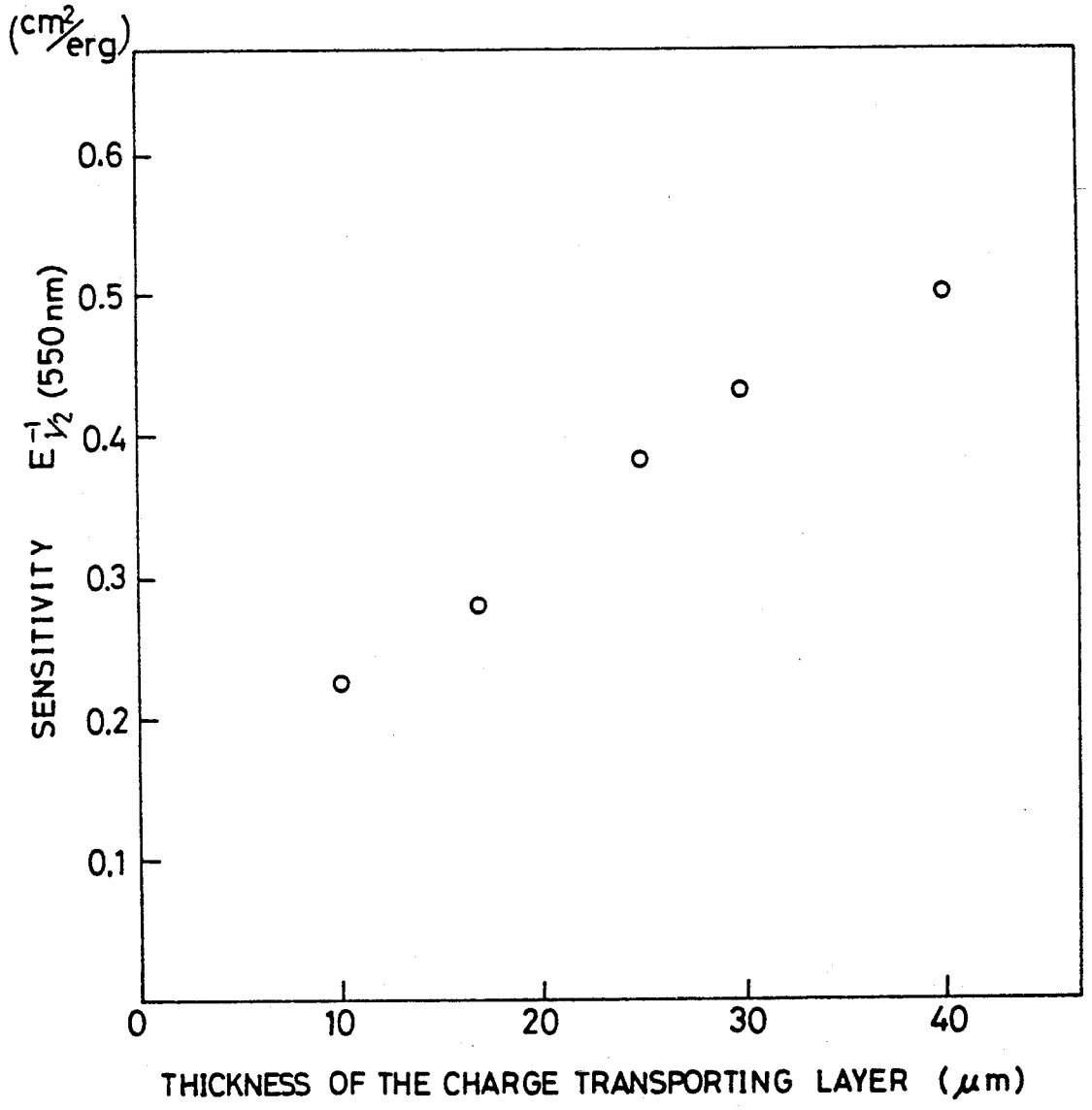
FIG. 2 illustrates a relationship between a film thickness (abscissa) and reciprocal for the sensitivity E ½ (ordinate) in the photoreceptor in Example 1.

For these photoreceptors, it can be seen that along with the increase of the thickness of the charge transporting layer, the sensitivity may be rather improved in addition to the increase of the charging property and that there is no remarkable disadvantage such as an increase of the residual potential. FIG. 2 shows a relationship between the film thickness (abscissa) and the reciprocal of the sensitivity E ½ at 550 nm (ordinate).

Then, durability test was conducted for the samples 1-B and 1-D by using them as the photoreceptor in a commercially available copying machine having a blade cleaning process (SF 8200, manufactured by Sharp Corp.). The results are shown in Table 2.

TABLE 2

| Sample | Before copying Vd (v) | Before copying VL (v) | Before copying Vr (v) | After copying 50,000 sheets Vd (v) | After copying 50,000 sheets VL (v) | After copying 50,000 sheets Vr (v) | After copying 100,000 sheets Vd (v) | After copying 100,000 sheets VL (v) | After copying 100,000 sheets Vr (v) |
|---|---|---|---|---|---|---|---|---|---|
| 1-B | 700 | 120 | 12 | 590 | 100 | 15 | 480 | 80 | 25 |
| 1-D | 700 | 120 | 15 | 650 | 120 | 25 | 600 | 130 | 40 |

Vd represents the surface potential in an unexposed area, VL represents the surface potential in an exposed area and Vr represents the residual potential, respectively (also in Table 4). In both the photoreceptors 1-B and 1-D, decrease of about 6 μm in thickness was observed after copying 100,000 sheets. However, in the sample 1-D, although a slight increase in the residual potential was observed, the surface potentials were little reduced and image quality was not changed at all after the above copying operation, so that 1-D was proved to have the durability for more than 100,000 copies. On the other hand, in the sample 1-B, although there was no remarkable change in image quality up to 50,000 sheets of copy, there was observed, after that, a gradual reduction in density and, the potentials were greatly reduced to lower the image density after 100,000 sheets of copy. From a practical point of view, the life of 1-B was estimated to be about 50,000 sheets.

EXAMPLE 2

Photoreceptor samples 2-A, 2-B, 2-C, 2-D and 2-E were prepared in the same procedures as in Example 1 except for using an azo dye II having the following structure as the charge generating material. The film thickness of each charge transporting layer was 10 μm, 16 μm, 25 μm 30 μm and 42 μm, respectively.

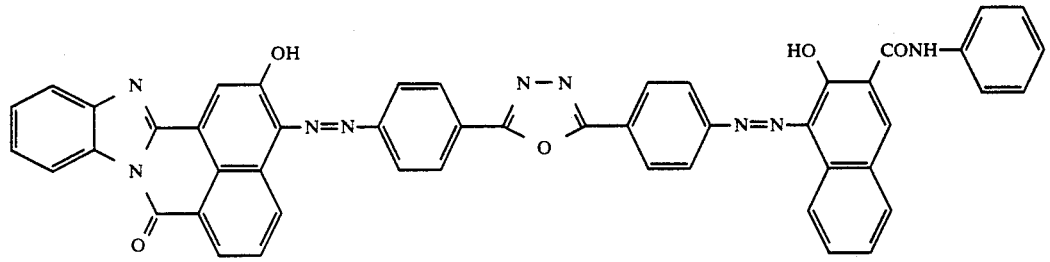

Azo dye II

Figure 3:
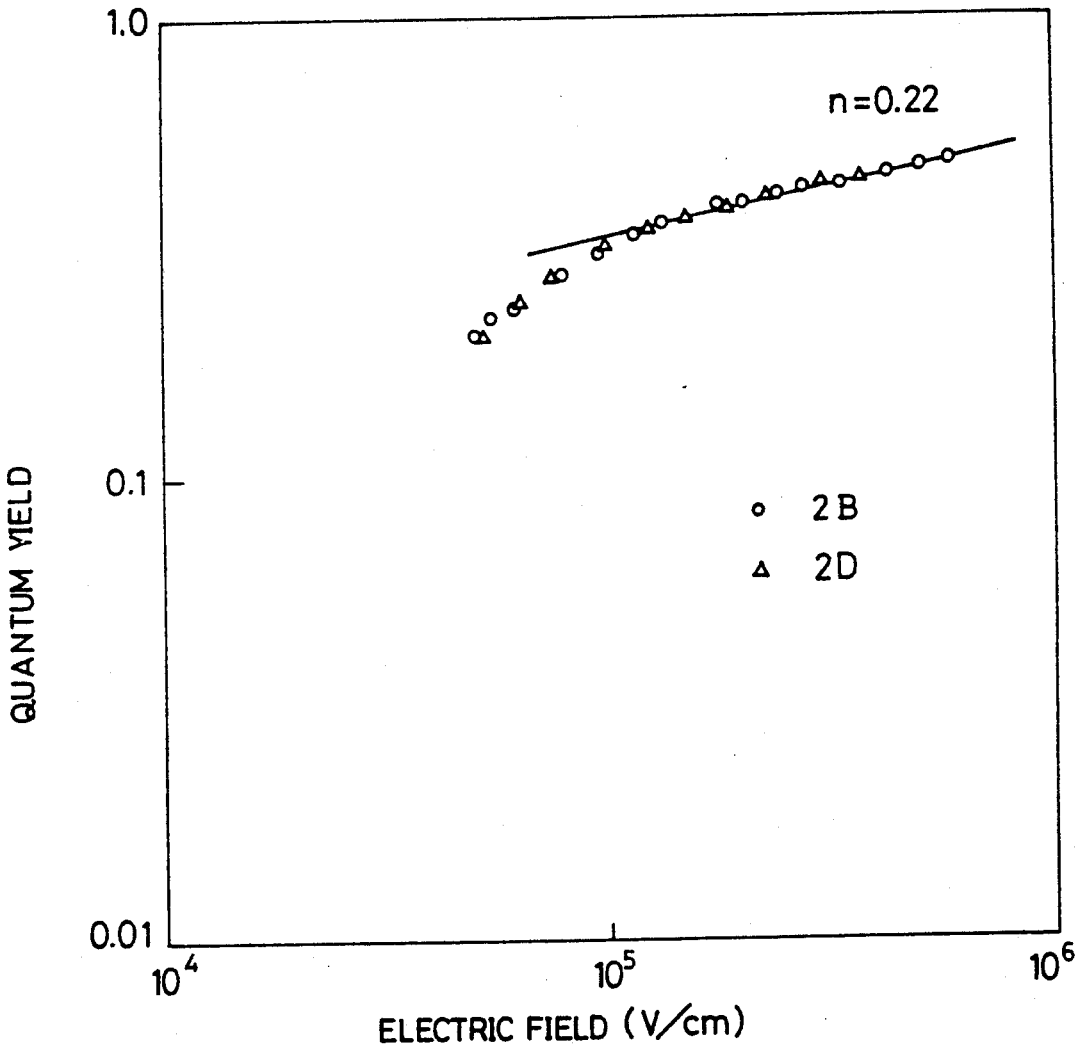
FIGS. 3, 4 and 5 show the quantum yield of the photoreceptors and the electric-field dependency thereof in Example 2, Comparative Examples 1 and 2, respectively.

The quantum yield as the whole photoreceptor was measured for the samples 2-B and 2-D in the same method as in Example 1. The results are shown in FIG. 3. In the case of these photoreceptors, it can be seen that the electric-field dependency is smaller than in Example 1 and the quantum yield may be approximated by an exponent of 0.22 for the electric field, thus showing no substantial dependency on the electric field.

For evaluating the dependency on the film thickness of the charge transporting layer in these photoreceptors, electric characteristics such as the sensitivity of the samples 2-A–2-E were measured. The results are shown in Table 3.

TABLE 3

| Sample | Thickness of charge transporting layer (μm) | Charge voltage (V) | White light E ½ (lux · sec) | 550 nm E ½ (erg/cm²) | Residual potential (V) |
|---|---|---|---|---|---|
| 2-A | 10 | 793 | 1.10 | 3.0 | 2 |
| 2-B | 16 | 1040 | 0.75 | 2.4 | 5 |
| 2-C | 25 | 1492 | 0.60 | 1.6 | 9 |
| 2-D | 30 | 1600 | 0.54 | 1.4 | 10 |
| 2-E | 42 | 1760 | 0.46 | 1.1 | 16 |

It can be seen also in these photoreceptors that the sensitivity may be improved along with the increase of the thickness of the charge transporting layer and that the sensitivity is remarkably high when the film thickness is great, without accompanying any problem.

Durability test was conducted for the sample 2-D in the same manner as in Example 1 and it was found that there was no particular change in image quality after copying 150,000 sheets and that a high printing durability may be obtained by increasing the film thickness greater than that in the conventional case. The data for the potential characteristics in this case are shown in Table 4.

TABLE 4

| | Charge voltage | VL | Vr |
|---|---|---|---|
| Before copying | 700 V | 110 V | 10 V |
| After copying 150,000 sheets | 630 V | 140 V | 50 V |

COMPARATIVE EXAMPLE 1

Photoreceptor samples 3-A, 3-B, 3-C, 3-D and 3-E were prepared in the same procedures as in Example 1 except for using oxytitanium phthalocyanine as the charge generating material. The film thickness of each charge transporting layer was 10 μm, 18 μm, 25 μm, 30 μm and 41 μm, respectively.

Figure 4:
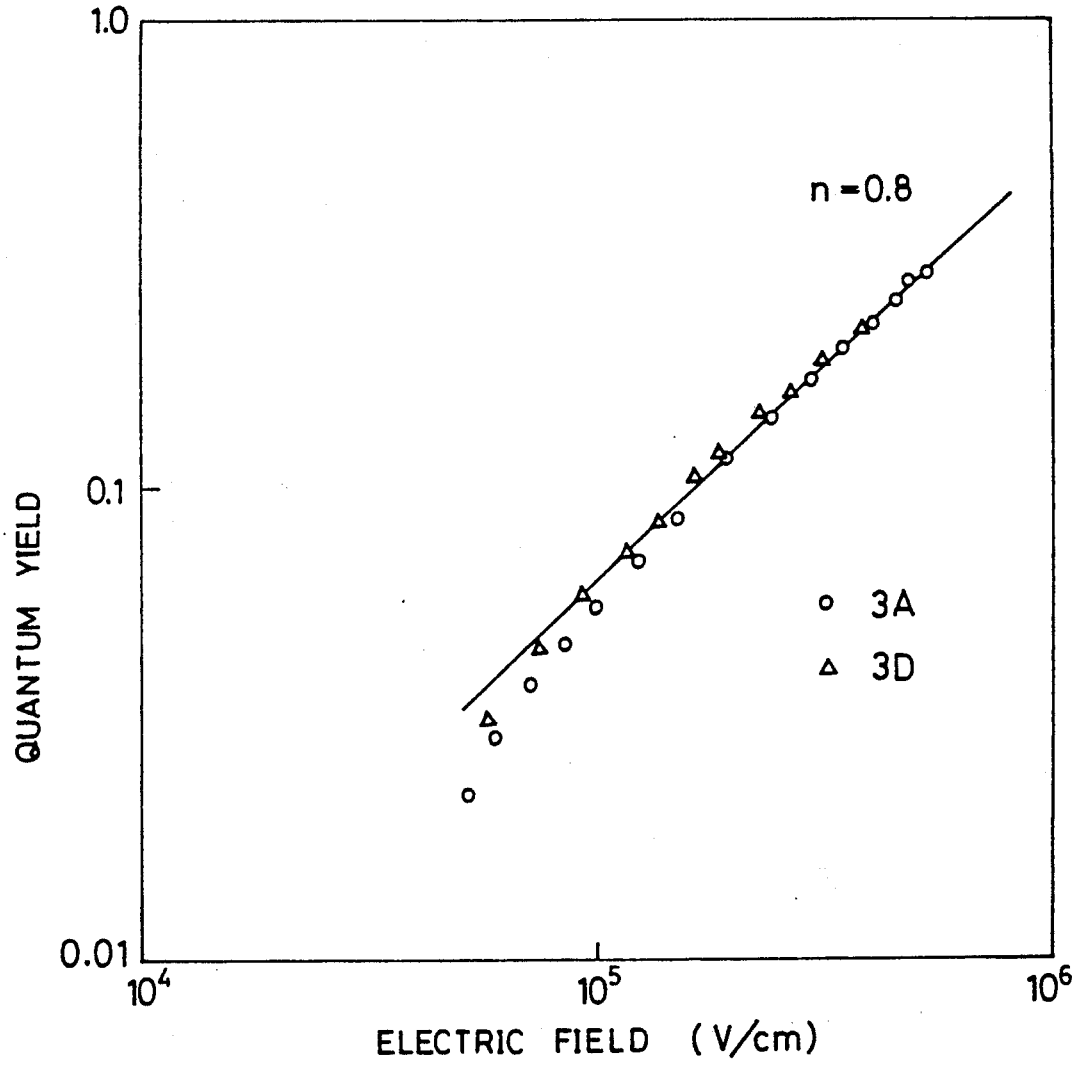

The quantum yield of these photoreceptors was determined in the same manner as in Example 1. Data obtained for the samples 3-A and 3-D are shown in FIG. 4. It was found from FIG. 4 that the dependency of the quantum yield on the electric field was great and the quantum yield may be approximately in proportion with an exponent of 0.9 for E.

Then, for evaluating a relationship between the properties and film thickness of the photoreceptors in this system, some properties for the sampls 3-A–3-E were measured. The results are shown in Table 5.

TABLE 5

| Sample | Thickness of charge trans-porting layer (μm) | Charge voltage (V) | White light E ½ (lux · sec) | 800 nm (erg/cm²) E ½ | 800 nm (erg/cm²) E 1/5 | Residual potential (V) |
|---|---|---|---|---|---|---|
| 3-A | 10 | 655 | 0.7 | 4.6 | 11 | 14 |
| 3-B | 18 | 980 | 0.7 | 4.6 | 12 | 20 |
| 3-C | 25 | 1440 | 0.7 | 4.7 | 18 | 35 |
| 3-D | 30 | 1571 | 0.9 | 5.0 | 30 | 60 |
| 3-E | 41 | 1620 | 1.1 | 6.1 | 62 | 70 |

It was found that the dependency of the quantum yield on the electric field was great and that along with the increase of the film thickness, the sensitivity was worsened. Particularly, 1/5 decay exposure amount (represented by "E 1/5" in the above table) as a substantial index for the sensitivity when developing an image was increased and the residual potential was also remarkably increased, along with the increase of the film thickness. As seen from the above, use of the charge transporting layer with a film thickness of 25 μm or more would remarkably deteriorate the characteristics and make it difficult to employ such layer in practical use.

COMPARATIVE EXAMPLE 2

Photoreceptor samples 4-A, 4-B and 4-C were prepared in the same procedures as in Example 1 except for using an azo dye (III) having the following structure as the charge generating material. The film thickness of each charge transporting layer was 19 μm, 30 μm and 40 μm, respectively.

Figure 5:
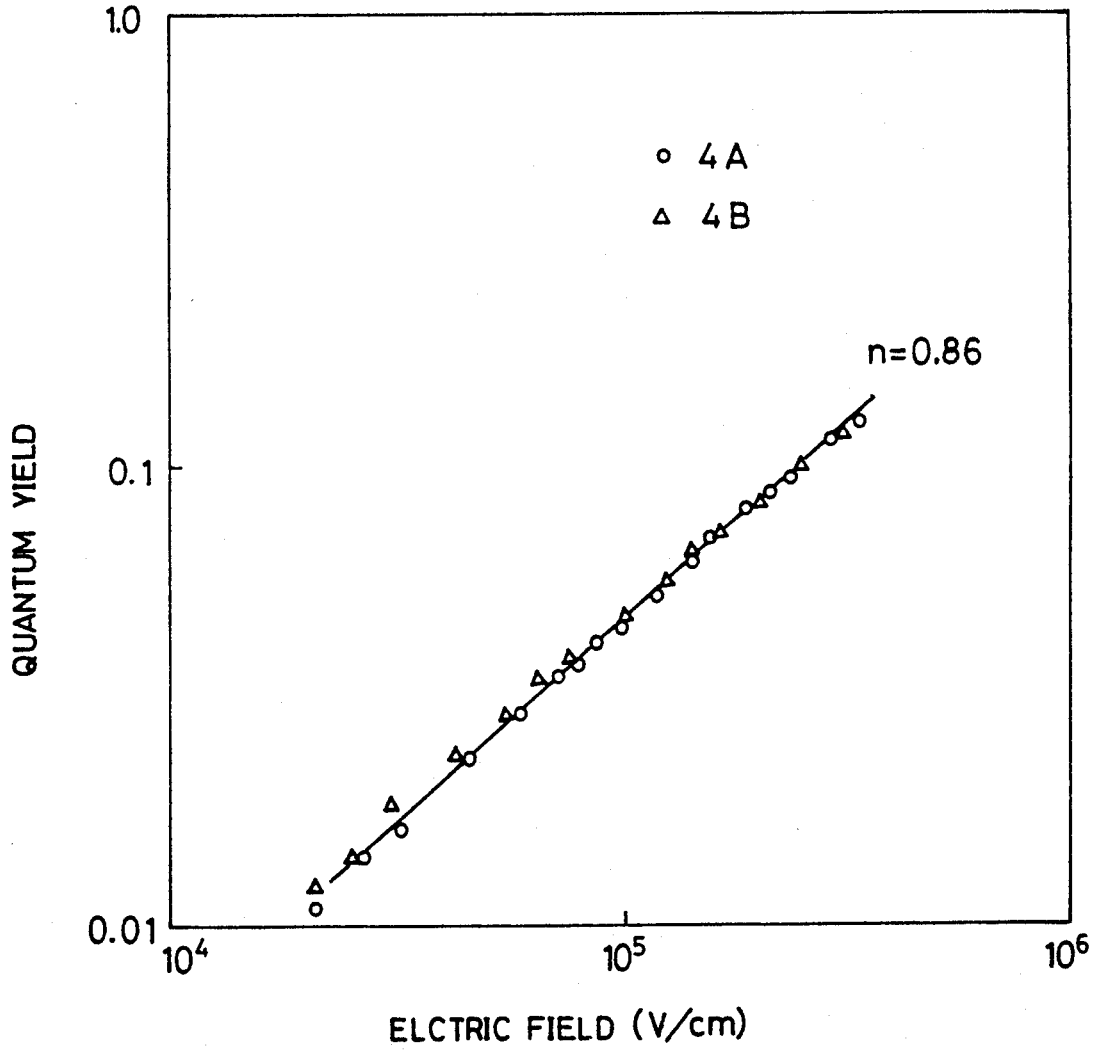

The quantum yield of these samples was determined in the same manner as in Example 1. Data obtained for the samples 4-A and 4-B are shown in FIG. 5. It can be seen from FIG. 5 that the dependency of the quantum yield on the electric field is also great and that it is approximately in proportion with an exponent of 0.86 for E.

Then, characteristics for the samples 4-A, 4-B and 4-C were measured for evaluating a relationship between the characteristics and film thickness of the photoreceptors in this system. The results are shown in Table 6.

TABLE 6

| Sample | Thickness of charge trans-porting layer (μm) | Charge voltage (V) | White light E ½ (lux · sec) | 550 nm (erg/cm²) E ½ | 550 nm (erg/cm²) E 1/5 | Residual potential (V) |
|---|---|---|---|---|---|---|
| 4-A | 19 | 967 V | 3.7 | 8.8 | 19.8 | 10 |
| 4-B | 30 | 1284 V | 3.4 | 8.4 | 18.6 | 20 |
| 4-C | 40 | 1423 V | 3.6 | 8.5 | 19.0 | 40 |

It can be seen that along with the increase of the film thickness, there is no particular change in sensitivity but only the residual potential was remarkably increased. It may be considered that use of the charge transporting layer with a film thickness of 30 μm or more would provide no particular advantage but rather deteriorate the characteristics of the photoreceptors.

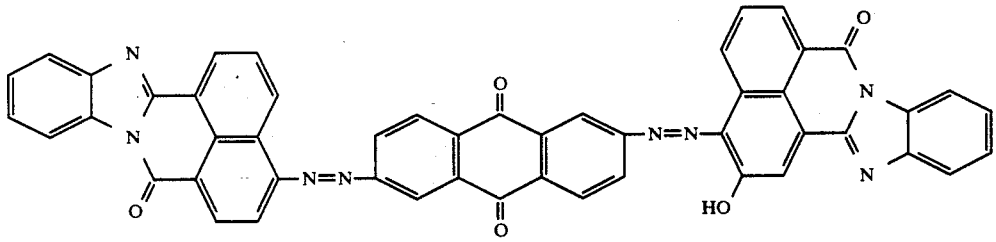

Azo dye (III)

What is claimed is:

1. A layered-type organic electrophotographic photoreceptor in which a charge generating layer containing organic charge generating material and a charge transporting layer containing organic charge transporting material are constructed on an electroconductive support, characterized in that the photoreceptor has a value n of not greater than 0.5 in the following equation (1) of an approximated straight line obtained by plotting both the electric field of from $1\times10^5$ V/cm to $5\times10^5$ V/cm and the quantum yield in a logarithmic scale:

$$n=n_0E^n \quad (1)$$

where n represents a quantum yield as the whole photoreceptor, E represents an electric field of from $1\times10^5$ V/cm to $5\times10^5$ V/cm, and $n_0$ represents a constant determined by said approximation, and specific to the photoreceptor, that a film thickness of said charge transporting layer is from about 30 to 60 μm (micrometer) and that said organic charge generating material comprises at least one material selected from the group consisting of azo dyes, phthalocyanine dyes, quinacridone dyes, perylene dyes, polycyclic quinone dyes, indigo dyes, benzoimidazole dyes, pyrylium salts, thiapyrylium salts, and squarylium salt pigments.

2. A layered-type organic electrophotographic photoreceptor according to claim 1, in which the film thickness of said charge transporting layer is from 35 μm to 50 μm.

3. A layered-type organic electrophotographic photoreceptor according to claim 2 or 1, in which said organic charge transporting material comprises at least one material selected from the group consisting of carbozole, indole, imidazole, oxazole, thiazole, oxadiazole, pyrazole, pyrazoline, thiadiazole, aniline derivatives, hydrazone derivatives, conjugated system compounds having stilbene skelton and those polymers having groups derived from such compounds in a main or side chain, 2,4,7-trinitrofluorenone and tetracyano quinodimethane.

* * * * *